US006537136B1

(12) United States Patent
Carlson

(10) Patent No.: US 6,537,136 B1
(45) Date of Patent: Mar. 25, 2003

(54) WEB-FORMAT POLISHING PADS AND METHODS FOR MANUFACTURING AND USING WEB-FORMAT POLISHING PADS IN MECHANICAL AND CHEMICAL-MECHANICAL PLANARIZATION OF MICROELECTRONIC SUBSTRATES

(75) Inventor: David W. Carlson, Windham, ME (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/644,274

(22) Filed: Aug. 22, 2000

Related U.S. Application Data

(62) Division of application No. 09/087,420, filed on May 29, 1998, now Pat. No. 6,210,257.

(51) Int. Cl.[7] ..... B24B 1/00

(52) U.S. Cl. ..... 451/41; 451/59; 451/63; 451/296; 451/56

(58) Field of Search ..... 451/41, 56, 59, 451/63, 296, 526

(56) References Cited

U.S. PATENT DOCUMENTS

| | | | | |
|---|---|---|---|---|
| 2,867,061 A | | 1/1959 | Heck | 451/296 |
| 4,558,542 A | | 12/1985 | Marton | 451/533 |
| 4,606,154 A | | 8/1986 | Herrmann et al. | 51/401 |
| 5,197,999 A | | 3/1993 | Thomas et al. | 51/298 |
| 5,212,910 A | | 5/1993 | Breivogel et al. | 51/398 |
| 5,584,146 A | | 12/1996 | Shamouillan et al. | 51/293 |
| 5,632,668 A | | 5/1997 | Lindholm et al. | 451/42 |
| 5,692,950 A | | 12/1997 | Rutherford et al. | 451/552 |
| 5,727,989 A | * | 3/1998 | Ohno et al. | 451/41 |
| 5,876,269 A | | 3/1999 | Torii | 451/41 |
| 5,893,796 A | | 4/1999 | Birang et al. | 451/526 |
| 5,997,384 A | * | 12/1999 | Blalock | 451/41 |
| 6,139,402 A | * | 10/2000 | Moore | 451/41 |
| 6,179,689 B1 | * | 1/2001 | Ohno et al. | 451/41 |

FOREIGN PATENT DOCUMENTS

JP 63-39769 2/1988

* cited by examiner

*Primary Examiner*—Timothy V. Eley
(74) *Attorney, Agent, or Firm*—Dorsey & Whitney LLP

(57) ABSTRACT

A web-format polishing pad for mechanical and/or chemical-mechanical planarization of microelectronic substrate assemblies, and methods for making and using such a web-format pad. In one aspect of the invention, a web-format polishing pad for planarizing a microelectronic substrate is made by slicing a cylindrical body of pad material along a cutting line that is at least substantially parallel to a longitudinal centerline of the body and at a radial depth inward from an exterior surface of the body. For example, a web of pad material can be sliced from the body by rotating the cylindrical body about the longitudinal centerline and pressing a cutting element against the rotating cylindrical body along the cutting line. The cutting element can be a knife with a sharp edge positioned at the cutting line and a face extending along a tangent of the cylindrical body. The cutting element can be moved radially inwardly as the body rotates to continuously peel a seamless web of pad material having a desired thickness from the cylindrical pad body. The web of pad material accordingly may be used on a web-format planarizing machine for planarizing microelectronic substrate assemblies.

60 Claims, 6 Drawing Sheets

WEB-FORMAT POLISHING PADS AND METHODS FOR MANUFACTURING AND USING WEB-FORMAT POLISHING PADS IN MECHANICAL AND CHEMICAL-MECHANICAL PLANARIZATION OF MICROELECTRONIC SUBSTRATES

CROSS-REFERENCE TO RELATED APPLICATION

This application is a divisional of U.S. patent application Ser. No. 09/087,420, filed May 29, 1998, now U.S Pat. No. 6,210,257.

TECHNICAL FIELD

The present invention generally relates to planarizing semiconductor wafers, field emission displays, and other microelectronic substrate assemblies used in the fabrication of microelectronic devices. More particularly, the invention is directed towards web-format polishing pads, and methods for making and using web-format polishing pads in mechanical and/or chemical-mechanical planarization of microelectronic substrates.

BACKGROUND OF THE INVENTION

Mechanical and chemical-mechanical planarizing processes (collectively "CMP") are used in the manufacturing of microelectronic devices for forming a flat surface on semiconductor wafers, field emission displays and many other microelectronic substrate assemblies. FIG. 1 schematically illustrates a planarizing machine 10 with a circular platen or table 20, a carrier assembly 30, a circular polishing pad 40, and a planarizing fluid 44 on the polishing pad 40. The planarizing machine 10 may also have an under-pad 25 attached to an upper surface 22 of the platen 20 for supporting the polishing pad 40. In many planarizing machines, a drive assembly 26 rotates (arrow A) and/or reciprocates (arrow B) the platen 20 to move the polishing pad 40 during planarization.

The carrier assembly 30 controls and protects a substrate 12 during planarization. The carrier assembly 30 typically has a substrate holder 32 with a pad 34 that holds the substrate 12 via suction. A drive assembly 36 of the carrier assembly 30 typically rotates and/or translates the substrate holder 32 (arrows C and D, respectively). The substrate holder 32, however, may be a weighted, free-floating disk (not shown) that slides over the polishing pad 40.

The combination of the polishing pad 40 and the planarizing fluid 44 generally define a planarizing medium that mechanically and/or chemically-mechanically removes material from the surface of the substrate 12. The polishing pad 40 may be a conventional polishing pad composed of a polymeric material (e.g., polyurethane) without abrasive particles, or it may be an abrasive polishing pad with abrasive particles fixedly bonded to a suspension material. In a typical application, the planarizing fluid 44 may be a CMP slurry with abrasive particles and chemicals for use with a conventional nonabrasive polishing pad. In other applications, the planarizing fluid 44 may be a chemical solution without abrasive particles for use with an abrasive polishing pad.

To planarize the substrate 12 with the planarizing machine 10, the carrier assembly 30 presses the substrate 12 against a planarizing surface 42 of the polishing pad 40 in the presence of the planarizing fluid 44. The platen 20 and/or the substrate holder 32 then move relative to one another to translate the substrate 12 across the planarizing surface 42. As a result, the abrasive particles and/or the chemicals in the planarizing medium remove material from the surface of the substrate 12.

CMP processes must consistently and accurately produce a uniformly planar surface on the substrate to enable precise fabrication of circuits and photo-patterns. Prior to being planarized, many substrates have large "step heights" that create a highly topographic surface across the substrate. Yet, as the density of integrated circuits increases, it is necessary to have a planar substrate surface at several stages of processing the substrate because non-uniform substrate surfaces significantly increase the difficulty of forming submicron features or photo-patterns to within a tolerance of approximately 0.1 $\mu$m. Thus, CMP processes must typically transform a highly topographical substrate surface into a highly uniform, planar substrate surface (e.g., a "blanket surface").

One particularly promising planarizing machine to enhance the planarity of the substrates is a web-format machine that uses a long, flexible polishing pad. FIG. 2 is a schematic isometric view of a web-format planarizing machine 100 similar to a machine manufactured by EDC Corporation. The planarizing machine 100 may have a support table 110 with a base 112 at a workstation A defining a planarizing zone. The base 112 is generally a rigid panel or plate attached to the table 110 to provide a flat, solid surface to which a portion of a web-format planarizing pad 140 is supported during planarization. The planarizing machine 100 also has a plurality of rollers to guide, position, and hold the web-format pad 140 over the base 112. The rollers generally include a supply roller 120, first and second idler rollers 121*a* and 121*b*, first and second guide rollers 122*a* and 122*b*, and a take-up roller 123. The supply roller 120 carries an unused or pre-operative portion of the web 140, and the take-up roller 123 carries a used or post-operative portion of the web 140. A motor (not shown) drives at least one of the supply and take-up rollers to sequentially advance the web 140 across the base 112. As such, unused portions of the web 140 may be quickly substituted for worn sections. The first idler roller 121*a* and the first guide roller 122*a* stretch the web 140 over the base 112 to hold the web 140 stationary during operation.

The planarizing machine 100 also has a carrier assembly 130 to translate the substrate 12 across the web 140. In one embodiment, the carrier assembly 130 has a substrate holder 132 to pick up, hold and release the substrate 12 at appropriate stages of the planarizing process. The carrier assembly 130 may also have a support gantry 134 carrying a drive assembly 135. The drive assembly 135 generally translates along the gantry 134, and the drive assembly 135 has an actuator 136, a drive shaft 137 coupled to the actuator 136, and an arm 138 projecting from the drive shaft 137. The arm 138 carries the substrate holder 132 via another shaft 139. The drive assembly 135 may also have another actuator (not shown) to rotate the shaft 139 and the substrate holder about an axis C-C as the actuator 136 orbits the substrate holder 132 about the axis B-B.

One processing concern associated with web-format planarizing machines is that the web-format polishing pad 140 may produce surface asperities on the substrates, such as gouges, scratches or localized rough areas that exceed normal surface non-uniformities across an adequately planarized substrate. More particularly, conventional web-format polishing pads have a plurality of sections 146 attached to one another along seams 147. As a substrate passes over the pad 140, the seams 147 may gouge the substrate and produce asperities on the substrate surface. The seams 147 may even severely damage a substrate in more aggressive CMP processes or on softer materials. Additionally, the planarizing characteristics may vary from one pad section 146 to another. Therefore, conventional web-format polishing pads have several drawbacks that may adversely impact the planarity of the finished substrates.

In addition to such processing concerns, web-format polishing pads also have several manufacturing concerns. FIG. 3 is a schematic isometric view of a process for making a conventional web-format polishing pad in which a cylindrical body 150 of pad material (e.g., polyurethane) is formed in a mold (not shown). A number of individual circular polishing pads 40, which are generally used with the rotational planarizing machine 10 shown in FIG. 1, are formed from the cylindrical body 150. Each circular polishing pad 40 is generally formed by cutting the cylindrical body 150 along a cutting line substantially normal to the longitudinal center line "C/L" of the cylindrical body 150. To adapt the circular pads 40 for use in a web-format planarizing machine, a rectilinear pad section 146 is then cut from a circular polishing pad 40. The rectilinear pad sections 146 are then attached to one another to form the web-format polishing pad 140 with a plurality of seams 147 (FIG. 2).

One particular manufacturing concern of fabricating web-format polishing pads is that trimming the circular polishing pads 40 to form the rectilinear pad sections 146 is time consuming and wastes a significant amount of pad material. Another manufacturing concern of fabricating web-format polishing pads is that most planarizing machines currently in use require circular polishing pads 40 that fit on a rotating platen. Many pad manufacturers, therefore, are reticent to develop rectilinear molds for forming a rectilinear body of pad material. Thus, it is wasteful and time consuming to use existing polishing pad manufacturing equipment and processes to produce web-format pads.

SUMMARY OF THE INVENTION

The present invention is directed towards web-format polishing pads for mechanical and/or chemical-mechanical planarization of microelectronic substrate assemblies, along with methods for making and using such web-format pads. In one aspect of the invention, a web-format polishing pad is made by slicing a cylindrical body of pad material along a cutting line that is at least substantially parallel to a longitudinal centerline of the body and at a radial depth inward from an exterior surface of the body. For example, a web of pad material can be sliced from the cylindrical body by rotating the body about the longitudinal centerline and pressing a cutting element against the rotating cylindrical body along the cutting line. The cutting element can be a knife with a sharp edge positioned at the cutting line and a face extending along a tangent of the cylindrical body. Additionally, an actuator can move the cutting element radially inwardly as the body rotates to continuously peel a seamless web of pad material having a desired thickness from the cylindrical pad body. The web of pad material accordingly may be used on a web-format planarizing machine for planarizing microelectronic substrates.

DETAILED DESCRIPTION OF THE INVENTION

The present invention is directed toward web-format polishing pads, and methods for manufacturing and using such polishing pads, for mechanical and/or chemical-mechanical planarization of microelectronic substrate assemblies. Many specific details of certain embodiments of the invention are set forth in the following description and in FIGS. 4–6 to provide a thorough understanding of such embodiments. One skilled in the art, however, will understand that the present invention may have additional embodiments, or that the invention may be practiced without several of the details described in the following description.

Figure 1:
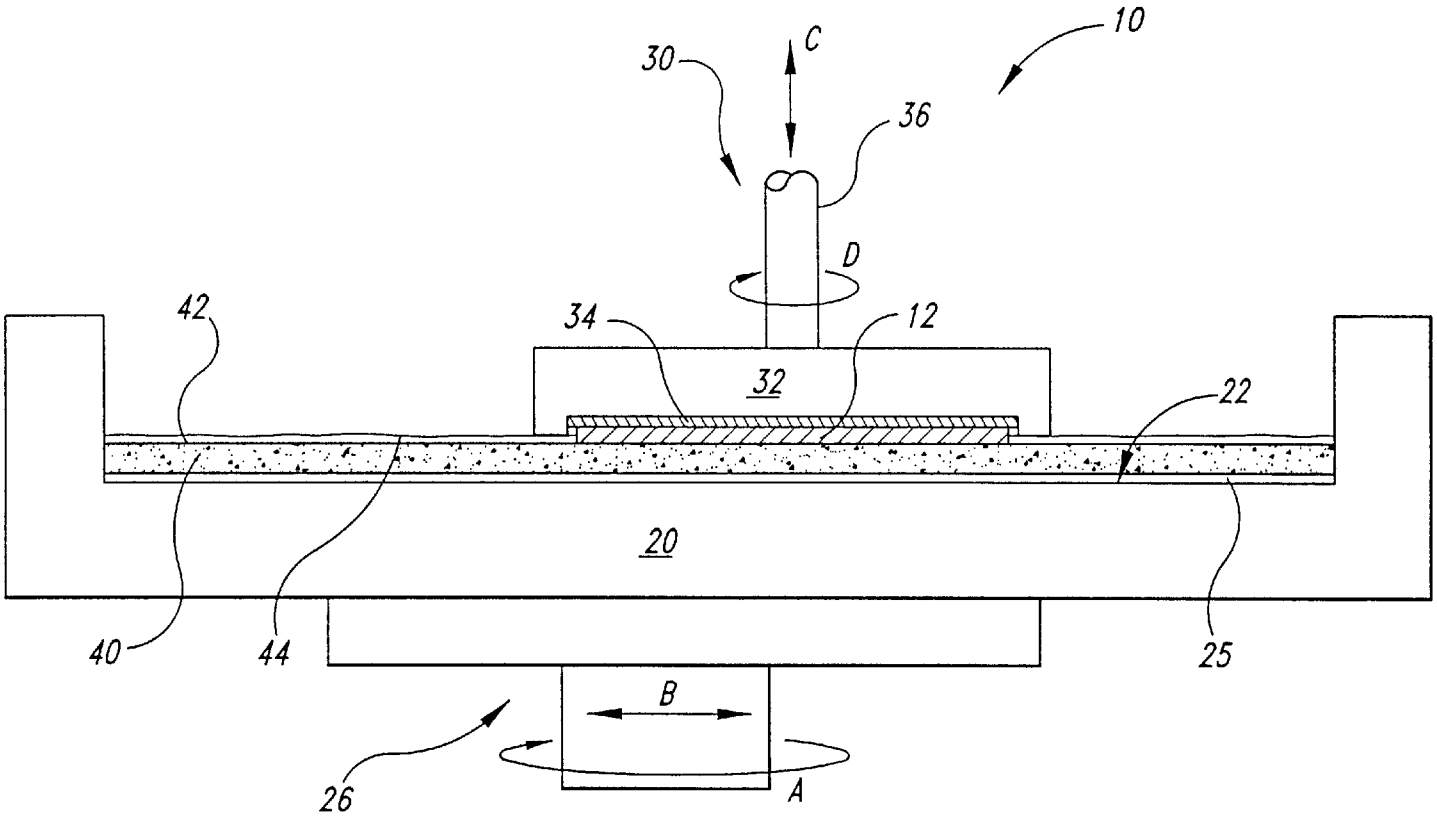
Fig. 1 (Prior Art)
FIG. 1 is a schematic cross-sectional view of a planarizing machine with a rotating platen in accordance with the prior art.
Figure 2:
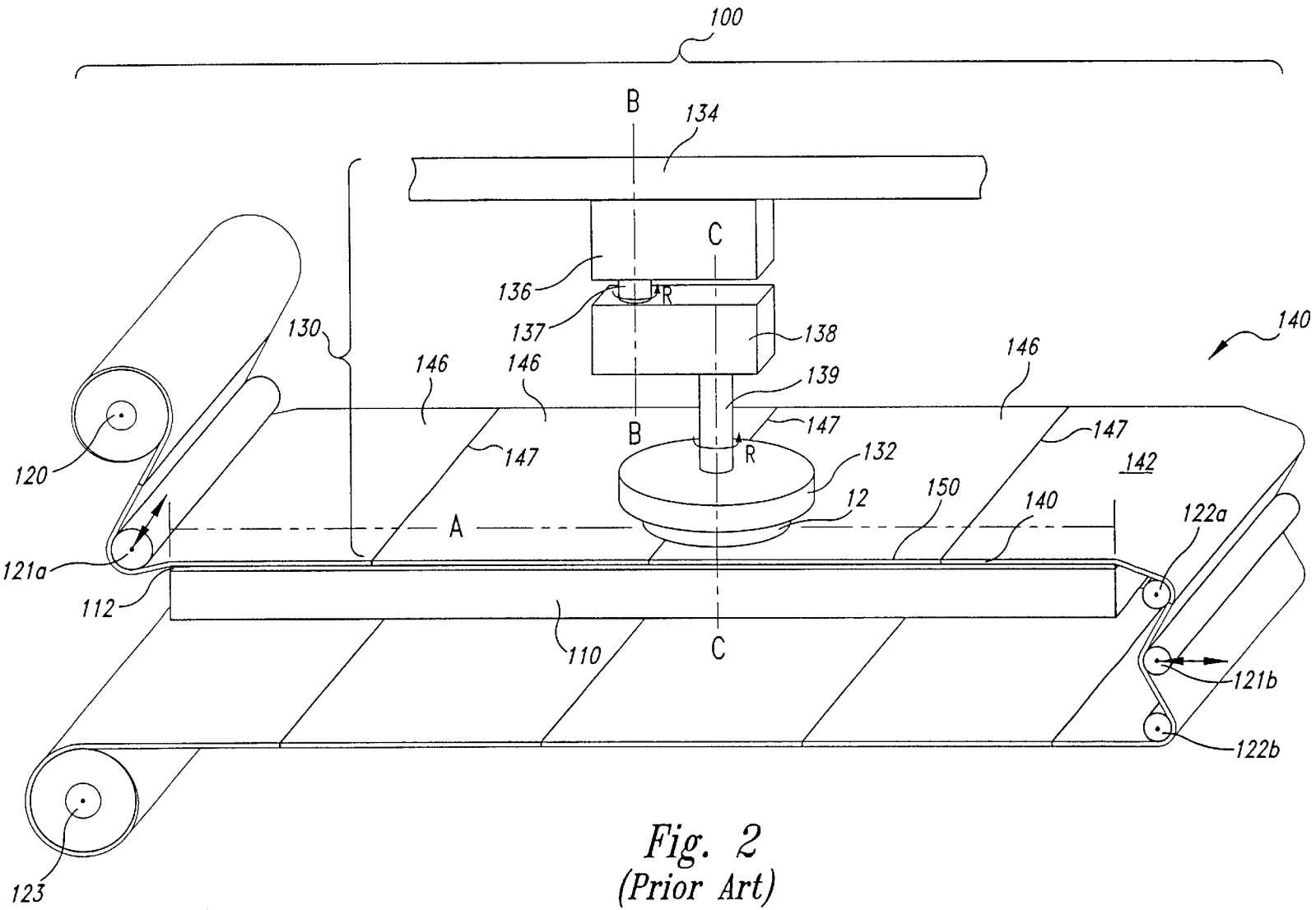
Fig. 2 (Prior Art)
FIG. 2 is a schematic isometric view of a web-format planarizing machine with a web-format polishing pad in accordance with the prior art.
Figure 3:
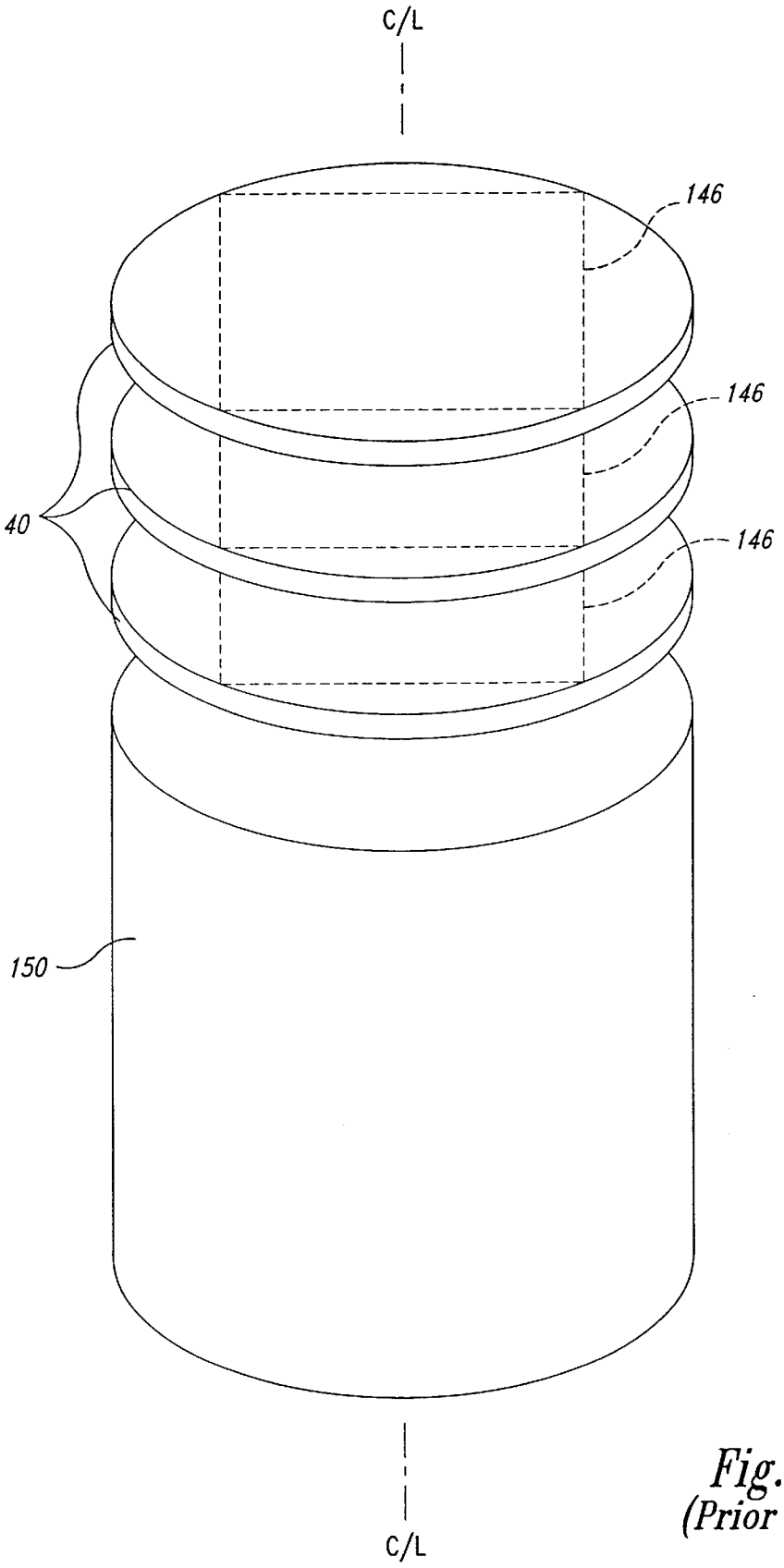
Fig. 3 (Prior Art)
FIG. 3 is an isometric view illustrating the manufacturing of a web-format polishing pad in accordance with the prior art.
Figure 4:
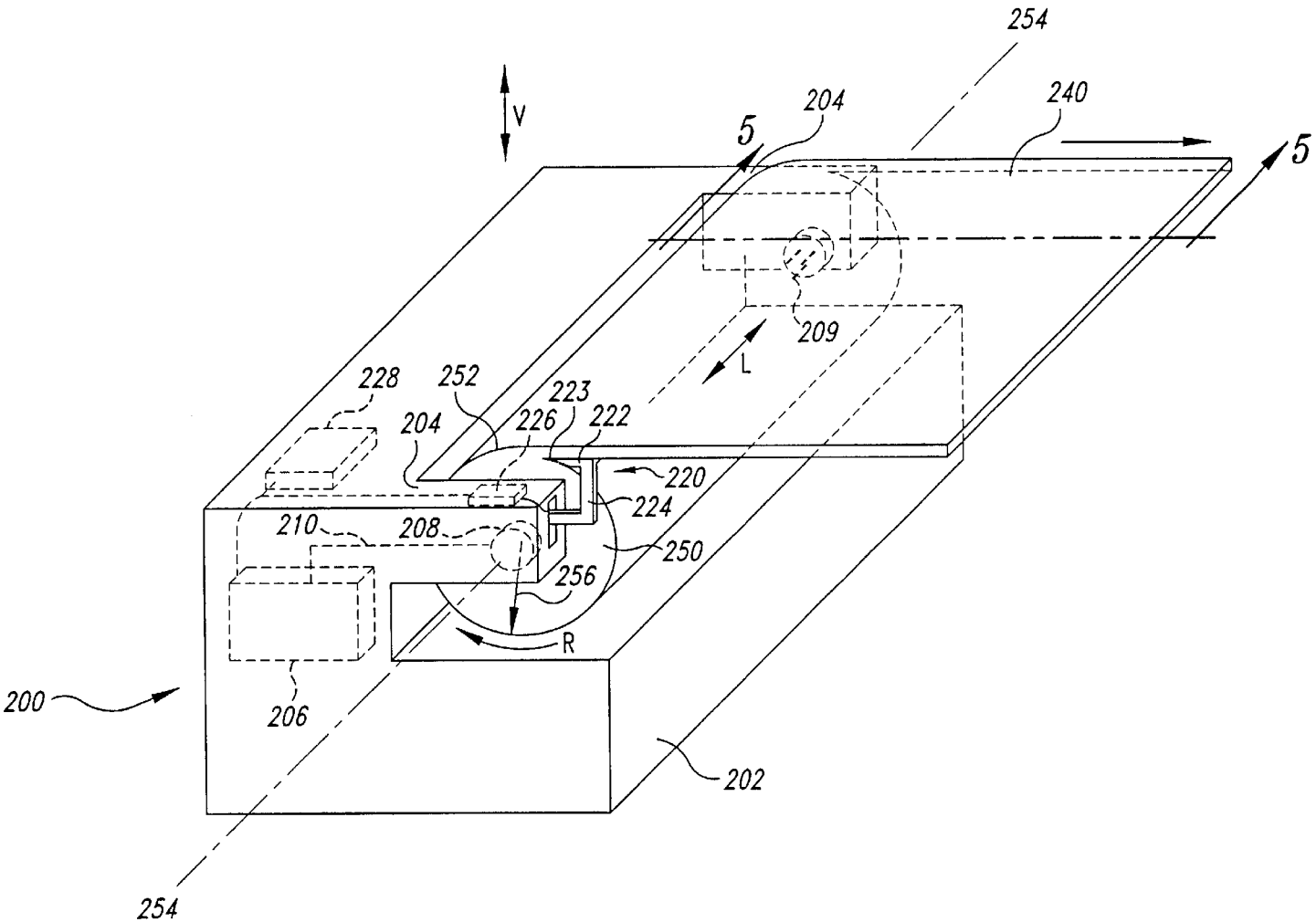
FIG. 4 is an isometric view of a web-format polishing pad and a method for making the web-format polishing pad in accordance with one embodiment of the invention.

FIG. 4 is a schematic isometric view of a cutting machine 200 illustrating a method for manufacturing a seamless web-format polishing pad 240 in accordance with one embodiment of the invention. The cutting machine 200 can have a housing 202 with a plurality of arms 204 projecting from an upper portion of the housing 202. The cutting machine 200 also includes a drive motor 206, a rotating chuck 208, and a drive mechanism 210 coupling the rotating chuck 208 to the drive motor 206. Each chuck 208 grips an end of a molded cylindrical body 250 of polishing pad material. For example, each chuck 208 can have a plurality of fingers 209 (shown in broken lines) that penetrate into the body 250 of pad material. The motor 206 accordingly drives the chucks 208 via the drive mechanism 210 to rotate the body 250 (arrow R) about its longitudinal centerline 254.

The cutting machine can also have a cutting assembly 220 mounted to the arms 204. The cutting assembly 220 preferably has a cutting element 222 with a cutting edge 223, and a bracket 224 at each end of the cutting element 222 (only one shown in FIG. 4). The bracket 224 holds the cutting element 222 at a desired elevation with respect to the arms 204. Each of the brackets 224 may also be coupled to an actuator 226 to move the brackets 224 and the cutting element 222 vertically (arrow V) and/or longitudinally (arrow L). As explained in more detail below, the drive motor 206 and the actuator 226 are both coupled to a controller 228 that controls the rotational velocity of the chuck 208 and the movement of the cutting element 222 to slice or peel a seamless web 240 from the body 250.

The cutting element 222 may have several different configurations. For example, the cutting element 222 can be a knife with a sharp cutting edge 223. Alternatively, the cutting element 222 can be a saw in which the cutting edge 223 has a plurality of fine teeth. In either type of cutting element, the actuator 226 moves the cutting assembly 220 vertically (arrow V) and may also reciprocate the cutting assembly 220 longitudinally (arrow L).

To manufacture a seamless web-format polishing pad 240, the cylindrical molded body 250 of pad material is mounted to the rotating chuck 208 of the cutting machine 200. The motor 206 rotates the chuck 208 to rotate the cylindrical body 250 (arrow R), and the actuator 226 positions the cutting element 222 at a radius 256 of the cylindrical body 250 inward from an exterior surface 252 of the body 250. As the cylindrical body 250 rotates, the cutting element 222 slices or peels a continuous web of pad material along a cutting line at least substantially parallel to the longitudinal center line 254 of the body 250. The cutting machine 200 accordingly forms a seamless web-format polishing pad 240.

Figure 5A:
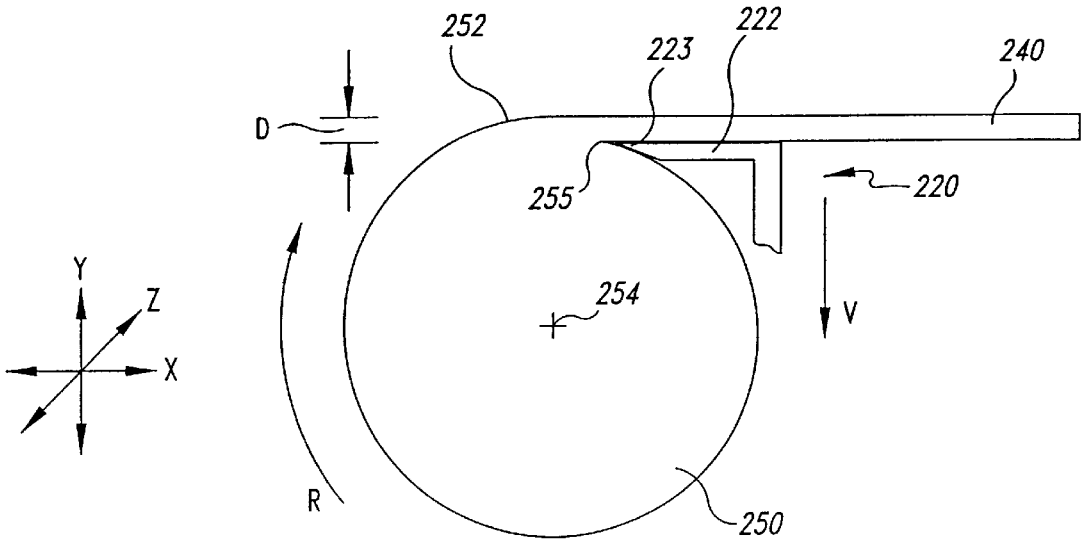
FIG. 5A is a partial cross-sectional view at one stage of the method for manufacturing the web-format polishing pad shown in FIG. 4 taken along line 5—5.
Figure 5B:
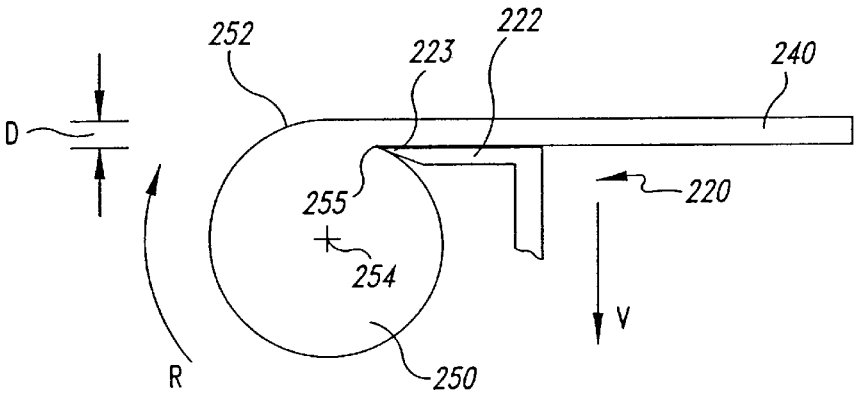
FIG. 5B is a partial cross-sectional view at a subsequent stage of the method for manufacturing the web-format polishing pad shown in FIG. 4 taken along line 5—5.

FIGS. 5A and 5B are schematic cross-sectional views along line 5—5 of FIG. 4 that further illustrate one embodiment for manufacturing a seamless web-format polishing pad 240 in accordance with the invention. Referring to FIG. 5A, the motor 206 (FIG. 4) rotates the cylindrical body 250 (arrow R) and the actuator 226 (FIG. 4) moves the cutting assembly 220 downward (arrow V) toward the centerline 254 to locate the cutting edge 223 at a radial depth D inward from the exterior surface 252. Additionally, the cutting edge 223 extends along a cutting line 255 that is at least substantially parallel to the longitudinal centerline 254 (e.g., the cutting line 255 and the longitudinal centerline 254 extend parallel to a Z-axis normal to the X-Y plane of the two-dimensional view of FIG. 5A). As the cylindrical body 250 rotates, the controller 228 (FIG. 4) preferably controls the actuator 226 to move the cutting assembly 220 downward at a rate that continuously positions the cutting edge 223 at a constant radial depth from the exterior surface 252 of the body 250. Referring to FIG. 5B, for example, the cutting assembly 220 has been moved toward the longitudinal center line 254 of the cylindrical body 250 to continuously slice the seamless web 240 such that the thickness of the web 240 is equal to the radial depth D. The controller 228, however, can move the cutting element 222 to vary the thickness of the web. Accordingly, the controller 228 may be programmed to control the actuator 226 and the motor 206 in a manner that moves the cutting assembly 220 toward the longitudinal center line of the body 250 in a predetermined relationship to the angular velocity of the cylindrical body 250. Programming the controller 228 according to the particular angular velocity of the pad body 250 and the linear velocity of the cutting assembly 220 is well within the knowledge of a person skilled in the art using known algorithms developed in the art of cutting wood plies in the manufacturing of plywood.

The cylindrical body 250 may be composed of several different materials. In general, the cylindrical body 250 may be a matrix of cast polyurethane film with a filler material to control the hardness of the polishing pads. Suitable cylindrical bodies of pad material are manufactured by Rodel Corporation of Newark, N.J. For example, seamless web-format polishing pads, in accordance with the invention, may be manufactured as set forth above with respect to FIGS. 4–5B from cylindrical bodies composed of the following pad materials:

(1) A Rodel Suba IV pad material having a specific gravity of 0.3, a compressibility of 16%, and a hardness of 55 (Shore A);

(2) A Rodel Suba 500 pad material having a specific gravity of 0.34, a compressibility of 12% and a hardness of 65 (Shore A);

(3) A Rodel IC-60 pad material having a specific gravity of 0.7, a very low compressibility less than 5%, and a hardness of 52–60 (Shore D);

(4) A Rodel IC-1000 polishing pad material having a specific gravity of 0.6–0.8, a compressibility of 5% or less, and a hardness greater than 52–60 (Shore D); and (5) A fixed-abrasive pad material having abrasive particles fixedly bonded to a suspension medium, as disclosed in U.S. Pat. No. 5,624,303, which is herein incorporated by reference.

Other types of polishing pad material may be used having different specific gravities, compressibilities and hardnesses. In general, the specific gravity indicates the pad porosity such that low specific gravities correspond to highly porous pads. Additionally, hardness and compressibility/resiliency features of the polishing pads are important because hard, substantial non-compressible polishing pads generally produce better global planarity on a substrate surface. Thus, the polishing pad material may be any suitable polymeric material, or other type of material, having the appropriate porosity, hardness and compressibility/resiliency properties to planarize a microelectronic substrate assembly.

Figure 6:
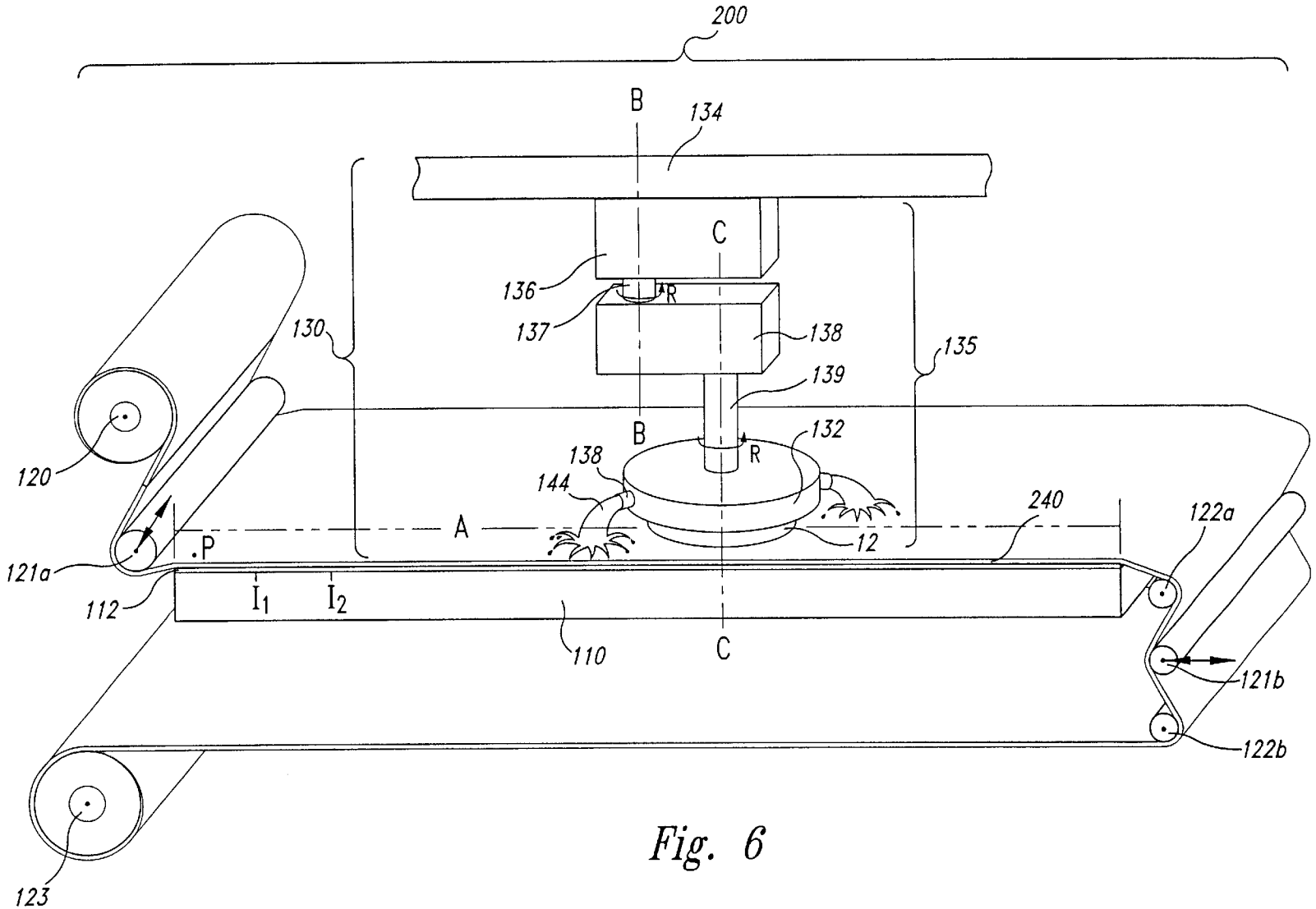
FIG. 6 is an isometric view of a planarizing machine and a process of planarizing a microelectronic substrate on a seamless web-format polishing pad in accordance with an embodiment of the invention.

FIG. 6 is a schematic isometric view illustrating planarizing a microelectronic substrate 12 on a seamless web-format polishing pad 240 in accordance with an embodiment of the invention. The polishing pad 240 is a continuous, seamless web of pad material having a planarizing surface 242 and a length extending beyond the table 210 of the planarizing machine 100. The polishing pad 240 accordingly has a first portion wrapped around the supply roller 120, a second portion on the table 110, and a third portion wrapped around the take-up roller 123. In operation, the carrier assembly 130 presses the substrate 12 against the planarizing surface 242 of the seamless polishing pad 240, and the carrier assembly 130 drives the substrate holder 132 to move the substrate 12 with respect to the polishing pad 240. A planarizing solution, such as a slurry with abrasive particles or a non-abrasive liquid 144, flows from a plurality of nozzles 138 on the substrate holder 132 as the substrate 12 translates across the pad 240. The abrasive particles and/or the chemicals on the planarizing surface 242 of the pad 240 accordingly remove material from the face of the substrate 12.

The seamless pad 240 may also be incrementally moved across the table 110 either during or between planarizing cycles to change the particular portion of the polishing pad 240 in a planarizing zone defined by the motion of the substrate holder 132 and/or the table 110. For example, the supply and take-up rollers 120 and 123 can drive the polishing pad 240 such that a point P moves incrementally across the table 110 to a number of intermediate locations $I_1$, $I_2$, etc. Alternatively, the rollers 120 and 123 may drive the polishing pad 240 such that the point P moves all the way across the table 110 to completely remove a used portion of the pad 240 from the planarizing zone on the table 110. The rollers may also continuously drive the polishing pad at a slow rate such that the point P moves continuously across the table 110.

One aspect of the particular embodiment of the process for manufacturing the seamless polishing pad 240 is that it significantly reduces the time and waste associated with conventional processes that cut rectilinear sections from circular pads to fabricate a conventional web-format pad. For example, the process described above with respect to FIGS. 4–5B does not require separately attaching individual pad sections together along abutting edges. Additionally, compared to conventional methods, forming the seamless polishing pad 240 using the cutting machine 200 is expected to reduce the waste of pad material. Therefore, several embodiments of methods in accordance with the invention are expected to reduce the time and waste for producing web-format polishing pads.

Another aspect of manufacturing the seamless polishing pad 240 in accordance with the particular embodiment described above is that conventional cylindrical molds for circular pads may be used to form a seamless web-format polishing pad. Pad manufacturers can accordingly make both circular pads and seamless web-format pads without changing molds or developing new molding processes. As such, several embodiments of the invention are also expected to significantly simplify polishing pad manufacturing operations.

Still another aspect of the particular embodiment of planarizing a microelectronic substrate on the seamless polishing pad 240 is that it is expected to reduce the number and extent of surface asperities on the substrate surface compared to conventional web-format polishing pads. Unlike conventional web-format polishing pads that have seams, the polishing pad 240 is a continuous, seamless web-format pad. Accordingly, the seamless polishing pad 240 does not have seams that may gouge or otherwise produce asperities on the substrate surface.

From the foregoing it will be appreciated that, although specific embodiments of the invention have been described herein for purposes of illustration, various modifications may be made without deviating from the spirit and scope of the invention. For example, after slicing the seamless web 240 from the cylindrical body 250 of pad material, the seamless web 240 may be adhered to a backing ply to enhance the structural integrity of the web 240. One suitable material for the backing ply is Mylar®, manufactured by E.I. duPont DeNemours of Delaware. Accordingly, the invention is not limited except as by the appended claims.

What is claimed is:

1. A method of planarizing a microelectronic substrate assembly, comprising:

cutting a cylindrical body of pad material to form a seamless web having a desired thickness, wherein cutting further comprises slicing the cylindrical body of pad material along a cutting line at least substantially parallel to a longitudinal centerline of the body and at a radial depth inward from an exterior surface of the body toward the centerline;

pressing the substrate assembly against a planarizing surface of the seamless web by supporting the web with a table defining a planarizing zone and applying a downforce against the substrate;

moving at least one of the substrate assembly with respect to the web for removing material from the substrate; and sliding the web across the table to move one portion of the web out of the planarizing zone and to move another portion of the web into the planarizing zone without removing the web from the table.

2. The method of claim 1 wherein slicing a cylindrical body comprises:

positioning an edge of a cutting element along the cutting line; and rotating the cylindrical body against the cutting edge, the cutting edge peeling the seamless web from the body.

3. The method of claim 2 wherein positioning the edge of the cutting element along the cutting line comprises moving the cutting element radially inward toward the centerline as the cylindrical body rotates.

4. The method of claim 3 wherein moving the cutting element comprises controlling the movement of the cutting element to maintain a desired radial depth inward from an exterior surface of the body as the cutting element slices the seamless web from the body.

5. The method of claim 3 wherein moving the cutting element comprises controlling the movement of the cutting element to maintain a constant radial depth inward from an exterior surface of the body as the cutting element slices the seamless web from the body.

6. The method of claim 1 wherein cutting the cylindrical body comprises peeling the seamless web from a cylindrical body of polymeric pad material having a specific gravity of approximately 0.3, a compressibility of approximately 16%, and a hardness of approximately 55 Shore A.

7. The method of claim 1 wherein cutting the cylindrical body comprises peeling the seamless web from a cylindrical body of polymeric pad material having a specific gravity of approximately 0.34, a compressibility of approximately 12%, and a hardness of approximately 65 Shore A.

8. The method of claim 1 wherein cutting the cylindrical body comprises peeling the seamless web from a cylindrical body of polymeric pad material having a specific gravity of approximately 0.7, a compressibility of approximately 5%, and a hardness of approximately 52–60 Shore D.

9. The method of claim 1 wherein cutting the cylindrical body comprises peeling the seamless web from a cylindrical body of polymeric pad material having a specific gravity of approximately 0.6–0.8, a compressibility of approximately 2–7%, and a hardness of approximately 52–60 Shore D.

10. A method of planarizing a microelectronic substrate assembly, comprising:

cutting a cylindrical body of pad material to form a seamless web having a desired thickness, wherein cutting further comprises slicing the cylindrical body of pad material along a cutting line by positioning an edge of a cutting element along the cutting line at least substantially parallel to a longitudinal centerline of the body and at a radial depth inward from an exterior surface of the body toward the centerline;

rotating the cylindrical body against the cutting edge, the cutting edge peeling the seamless web from the body;

pressing the substrate assembly against a planarizing surface of the seamless web by supporting the web with a table defining a planarizing zone and applying a downforce against the substrate;

moving at least one of the substrate assembly with respect to the web for removing material from the substrate; and sliding the web across the table to move one portion of the web out of the planarizing zone and to move another portion of the web into the planarizing zone without removing the web from the table.

11. The method of claim 10 wherein positioning the edge of the cutting element along the cutting line comprises moving the cutting member radially inward toward the centerline as the cylindrical body rotates.

12. The method of claim 11 wherein moving the cutting member comprises controlling the movement of the cutting element to maintain a desired radial depth inward from an exterior surface of the body as the cutting element slices the seamless web from the body.

13. The method of claim 11 wherein moving the cutting element comprises controlling the movement of the cutting element to maintain a constant radial depth inward from an exterior surface of the body as the cutting element slices the seamless web from the body.

14. The method of claim 10 wherein cutting the cylindrical body comprises peeling the seamless web from a cylindrical body of polymeric pad material having a specific gravity of approximately 0.3, a compressibility of approximately 16%, and a hardness of approximately 55 Shore A.

15. The method of claim 10 wherein cutting the cylindrical body comprises peeling the seamless web from a cylindrical body of polymeric pad material having a specific gravity of approximately 0.34, a compressibility of approximately 12%, and a hardness of approximately 65 Shore A.

16. The method of claim 10 wherein cutting the cylindrical body comprises peeling the seamless web from a cylindrical body of polymeric pad material having a specific gravity of approximately 0.7, a compressibility of approximately 5%, and a hardness of approximately 52–60 Shore D.

17. The method of claim 10 wherein cutting the cylindrical body comprises peeling the seamless web from a cylindrical body of polymeric pad material having a specific gravity of approximately 0.6–0.8, a compressibility of approximately 2–7%, and a hardness of approximately 52–60 Shore D.

18. A method of planarizing a microelectronic substrate assembly, comprising:

cutting a cylindrical body of pad material to form a seamless web having a desired thickness, wherein cutting further comprises slicing the cylindrical body of pad material along a cutting line by positioning an edge of a cutting element along the cutting line at least substantially parallel to a longitudinal centerline of the body and at a radial depth inward from an exterior surface of the body toward the centerline;

rotating the cylindrical body against the cutting edge while moving the cutting element radially inward toward the centerline as the cylindrical body rotates, the cutting edge peeling the seamless web from the body;

pressing the substrate assembly against a planarizing surface of the seamless web by supporting the web with a table defining a planarizing zone and applying a downforce against the substrate;

moving at least one of the substrate assembly with respect to the web for removing material from the substrate; and sliding the web across the table to move one portion of the web out of the planarizing zone and to move another portion of the web into the planarizing zone without removing the web from the table.

19. The method of claim 18 wherein moving the cutting element comprises controlling the movement of the cutting element to maintain a desired radial depth inward from an exterior surface of the body as the cutting element slices the seamless web from the body.

20. The method of claim 18 wherein moving the cutting element comprises controlling the movement of the cutting element to maintain a constant radial depth inward from an exterior surface of the body as the cutting element slices the seamless web from the body.

21. The method of claim 18 wherein cutting the cylindrical body comprises peeling the seamless web from a cylindrical body of polymeric pad material having a specific gravity of approximately 0.3, a compressibility of approximately 16%, and a hardness of approximately 55 Shore A.

22. The method of claim 18 wherein cutting the cylindrical body comprises peeling the seamless web from a cylindrical body of polymeric pad material having a specific gravity of approximately 0.34, a compressibility of approximately 12%, and a hardness of approximately 65 Shore A.

23. The method of claim 18 wherein cutting the cylindrical body comprises peeling the seamless web from a cylindrical body of polymeric pad material having a specific gravity of approximately 0.7, a compressibility of approximately 5%, and a hardness of approximately 52–60 Shore D.

24. The method of claim 18 wherein cutting the cylindrical body comprises peeling the seamless web from a cylindrical body of polymeric pad material having a specific gravity of approximately 0.6–0.8, a compressibility of approximately 2–7%, and a hardness of approximately 52–60 Shore D.

25. A method of planarizing a microelectronic substrate assembly, comprising:

cutting a cylindrical body of pad material to form a seamless web having a desired thickness, wherein cutting further comprises slicing the cylindrical body of pad material along a cutting line by positioning an edge of a cutting element along the cutting line at least substantially parallel to a longitudinal centerline of the body and at a radial depth inward from an exterior surface of the body toward the centerline;

rotating the cylindrical body against the cutting edge while moving the cutting element radially inward toward the centerline as the cylindrical body rotates, the cutting edge peeling the seamless web from the body;

controlling the movement of the cutting element to maintain a desired radial depth inward from an exterior surface of the body as the cutting element slices the seamless web from the body;

pressing the substrate assembly against a planarizing surface of the seamless web by supporting the web with a table defining a planarizing zone and applying a downforce against the substrate;

moving at least one of the substrate assembly with respect to the web for removing material from the substrate; and sliding the web across the table to move one portion of the web out of the planarizing zone and to move another portion of the web into the planarizing zone without removing the web from the table.

26. The method of claim 25 wherein moving the cutting element comprises controlling the movement of the cutting element to maintain a constant radial depth inward from an exterior surface of the body as the cutting element slices the seamless web from the body.

27. The method of claim 25 wherein cutting the cylindrical body comprises peeling the seamless web from a cylindrical body of polymeric pad material having a specific gravity of approximately 0.3, a compressibility of approximately 16%, and a hardness of approximately 55 Shore A.

28. The method of claim 25 wherein cutting the cylindrical body comprises peeling the seamless web from a cylindrical body of polymeric pad material having a specific gravity of approximately 0.34, a compressibility of approximately 12%, and a hardness of approximately 65 Shore A.

29. The method of claim 25 wherein cutting the cylindrical body comprises peeling the seamless web from a cylindrical body of polymeric pad material having a specific gravity of approximately 0.7, a compressibility of approximately 5%, and a hardness of approximately 52–60 Shore D.

30. The method of claim 25 wherein cutting the cylindrical body comprises peeling the seamless web from a cylindrical body of polymeric pad material having a specific gravity of approximately 0.6–0.8, a compressibility of approximately 2–7%, and a hardness of approximately 52–60 Shore D.

31. A method of planarizing a microelectronic substrate assembly, comprising:

cutting a cylindrical body of pad material to form a seamless web having a desired thickness, wherein cutting further comprises slicing the cylindrical body of pad material along a cutting line by positioning an edge of a cutting element along the cutting line at least substantially parallel to a longitudinal centerline of the body and at a radial depth inward from an exterior surface of the body toward the centerline;

rotating the cylindrical body against the cutting edge while moving the cutting element radially inward toward the centerline as the cylindrical body rotates, the cutting edge peeling the seamless web from the body;

controlling the movement of the cutting element to maintain a constant radial depth inward from an exterior surface of the body as the cutting element slices the seamless web from the body;

pressing the substrate assembly against a planarizing surface of the seamless web by supporting the web with a table defining a planarizing zone and applying a downforce against the substrate;

moving at least one of the substrate assembly with respect to the web for removing material from the substrate; and sliding the web across the table to move one portion of the web out of the planarizing zone and to move another portion of the web into the planarizing zone without removing the web from the table.

32. The method of claim 31 wherein moving the cutting element comprises controlling the movement of the cutting element to maintain a desired radial depth inward from an exterior surface of the body as the cutting element slices the seamless web from the body.

33. The method of claim 31 wherein cutting the cylindrical body comprises peeling the seamless web from a cylindrical body of polymeric pad material having a specific gravity of approximately 0.3, a compressibility of approximately 16%, and a hardness of approximately 55 Shore A.

34. The method of claim 31 wherein cutting the cylindrical body comprises peeling the seamless web from a cylindrical body of polymeric pad material having a specific gravity of approximately 0.34, a compressibility of approximately 12%, and a hardness of approximately 65 Shore A.

35. The method of claim 31 wherein cutting the cylindrical body comprises peeling the seamless web from a cylindrical body of polymeric pad material having a specific gravity of approximately 0.7, a compressibility of approximately 5%, and a hardness of approximately 52–60 Shore D.

36. The method of claim 31 wherein cutting the cylindrical body comprises peeling the seamless web from a cylindrical body of polymeric pad material having a specific gravity of approximately 0.6–0.8, a compressibility of approximately 2–7%, and a hardness of approximately 52–60 Shore D.

37. A method of planarizing a microelectronic substrate assembly, comprising:

cutting a cylindrical body of pad material to form a seamless web having a desired thickness, wherein cutting the cylindrical body comprises peeling the seamless web from a cylindrical body of polymeric pad material having a specific gravity of approximately 0.3, a compressibility of approximately 16%, and a hardness of approximately 55 Shore A;

pressing the substrate assembly against a planarizing surface of the seamless web by supporting the web with a table defining a planarizing zone and applying a downforce against the substrate;

moving at least one of the substrate assembly with respect to the web for removing material from the substrate; and sliding the web across the table to move one portion of the web out of the planarizing zone and to move another portion of the web into the planarizing zone without removing the web from the table.

38. The method of claim 37 wherein cutting a cylindrical body comprises slicing the cylindrical body of pad material along a cutting line at least substantially parallel to a longitudinal centerline of the body and at a radial depth inward from an exterior surface of the body toward the centerline.

39. The method of claim 37 wherein slicing a cylindrical body comprises:

positioning an edge of a cutting element along the cutting line; and rotating the cylindrical body against the cutting edge, the cutting edge peeling the seamless web from the body.

40. The method of claim 39 wherein positioning the edge of the cutting element along the cutting line comprises moving the cutting element radially inward toward the centerline as the cylindrical body rotates.

41. The method of claim 40 wherein moving the cutting element comprises controlling the movement of the cutting element to maintain a desired radial depth inward from an exterior surface of the body as the cutting element slices the seamless web from the body.

42. The method of claim 40 wherein moving the cutting element comprises controlling the movement of the cutting element to maintain a constant radial depth inward from an exterior surface of the body as the cutting element slices the seamless web from the body.

43. A method of planarizing a microelectronic substrate assembly, comprising:

cutting a cylindrical body of pad material to form a seamless web having a desired thickness, wherein cutting the cylindrical body comprises peeling the seamless web from a cylindrical body of polymeric pad material having a specific gravity of approximately 0.34, a compressibility of approximately 12%, and a hardness of approximately 65 Shore A;

pressing the substrate assembly against a planarizing surface of the seamless web by supporting the web with a table defining a planarizing zone and applying a downforce against the substrate;

moving at least one of the substrate assembly with respect to the web for removing material from the substrate; and sliding the web across the table to move one portion of the web out of the planarizing zone and to move another portion of the web into the planarizing zone without removing the web from the table.

44. The method of claim 43 wherein cutting a cylindrical body comprises slicing the cylindrical body of pad material along a cutting line at least substantially parallel to a longitudinal centerline of the body and at a radial depth inward from an exterior surface of the body toward the centerline.

45. The method of claim 44 wherein slicing a cylindrical body comprises:

positioning an edge of a cutting element along the cutting line; and rotating the cylindrical body against the cutting edge, the cutting edge peeling the seamless web from the body.

46. The method of claim 45 wherein positioning the edge of the cutting element along the cutting line comprises moving the cutting element radially inward toward the centerline as the cylindrical body rotates.

47. The method of claim 46 wherein moving the cutting element comprises controlling the movement of the cutting element to maintain a desired radial depth inward from an exterior surface of the body as the cutting element slices the seamless web from the body.

48. The method of claim 46 wherein moving the cutting element comprises controlling the movement of the cutting element to maintain a constant radial depth inward from an exterior surface of the body as the cutting element slices the seamless web from the body.

49. A method of planarizing a microelectronic substrate assembly, comprising:

cutting a cylindrical body of pad material to form a seamless web having a desired thickness, wherein cutting the cylindrical body comprises peeling the seamless web from a cylindrical body of polymeric pad material having a specific gravity of approximately 0.7, a compressibility of approximately 5%, and a hardness of approximately 52–60 Shore D;

pressing the substrate assembly against a planarizing surface of the seamless web by supporting the web with a table defining a planarizing zone and applying a downforce against the substrate;

moving at least one of the substrate assembly with respect to the web for removing material from the substrate; and sliding the web across the table to move one portion of the web out of the planarizing zone and to move another portion of the web into the planarizing zone without removing the web from the table.

50. The method of claim 49 wherein cutting a cylindrical body comprises slicing the cylindrical body of pad material along a cutting line at least substantially parallel to a longitudinal centerline of the body and at a radial depth inward from an exterior surface of the body toward the centerline.

51. The method of claim 50 wherein slicing a cylindrical body comprises:

positioning an edge of a cutting element along the cutting line; and rotating the cylindrical body against the cutting edge, the cutting edge peeling the seamless web from the body.

52. The method of claim 51 wherein positioning the edge of the cutting element along the cutting line comprises moving the cutting element radially inward toward the centerline as the cylindrical body rotates.

53. The method of claim 52 wherein moving the cutting element comprises controlling the movement of the cutting element to maintain a desired radial depth inward from an exterior surface of the body as the cutting element slices the seamless web from the body.

54. The method of claim 52 wherein moving the cutting element comprises controlling the movement of the cutting element to maintain a constant radial depth inward from an exterior surface of the body as the cutting element slices the seamless web from the body.

55. A method of planarizing a microelectronic substrate assembly, comprising:

cutting a cylindrical body of pad material to form a seamless web having a desired thickness, wherein cutting the cylindrical body comprises peeling the seamless web from a cylindrical body of polymeric pad material having a specific gravity of approximately 0.6–0.8, a compressibility of approximately 2–7%, and a hardness of approximately 52–60 Shore D;

pressing the substrate assembly against a planarizing surface of the seamless web by supporting the web with a table defining a planarizing zone and applying a downforce against the substrate;

moving at least one of the substrate assembly with respect to the web for removing material from the substrate; and sliding the web across the table to move one portion of the web out of the planarizing zone and to move another portion of the web into the planarizing zone without removing the web from the table.

56. The method of claim 55 wherein cutting a cylindrical body comprises slicing the cylindrical body of pad material along a cutting line at least substantially parallel to a longitudinal centerline of the body and at a radial depth inward from an exterior surface of the body toward the centerline.

57. The method of claim 56 wherein slicing a cylindrical body comprises:

positioning an edge of a cutting element along the cutting line; and rotating the cylindrical body against the cutting edge, the cutting edge peeling the seamless web from the body.

58. The method of claim 57 wherein positioning the edge of the cutting element along the cutting line comprises moving the cutting element radially inward toward the centerline as the cylindrical body rotates.

59. The method of claim 58 wherein moving the cutting element comprises controlling the movement of the cutting element to maintain a desired radial depth inward from an exterior surface of the body as the cutting element slices the seamless web from the body.

60. The method of claim 58 wherein moving the cutting element comprises controlling the movement of the cutting element to maintain a constant radial depth inward from an exterior surface of the body as the cutting element slices the seamless web from the body.

* * * * *